US011072017B2

(12) United States Patent
Unger

(10) Patent No.: US 11,072,017 B2
(45) Date of Patent: Jul. 27, 2021

(54) TOOL CARRIER FOR A CLINCHING DEVICE

(71) Applicant: Eckold GmbH & Co. KG, St. Andreasberg (DE)

(72) Inventor: Florian Unger, Bad Lauterberg (DE)

(73) Assignee: ECKOLD GMBH & CO. KG, St. Andreasberg (DE)

( * ) Notice: Subject to any disclaimer, the term of this patent is extended or adjusted under 35 U.S.C. 154(b) by 201 days.

(21) Appl. No.: 16/266,796

(22) Filed: Feb. 4, 2019

(65) Prior Publication Data

US 2019/0247907 A1 Aug. 15, 2019

(30) Foreign Application Priority Data

Feb. 9, 2018 (DE) ..... 10 2018 103 000.2

(51) Int. Cl.
*B21D 39/03* (2006.01)
*B21D 37/12* (2006.01)

(52) U.S. Cl.
CPC ..... *B21D 39/031* (2013.01); *B21D 37/12* (2013.01)

(58) Field of Classification Search
CPC ..... B21D 37/08; B21D 37/10; B21D 37/12; B21D 39/03; B21D 39/031; B21D 39/032; B21D 39/038
See application file for complete search history.

(56) References Cited

U.S. PATENT DOCUMENTS

| | | | | |
|---|---|---|---|---|
| 5,208,974 | A | 5/1993 | Sawdon et al. | |
| 6,862,793 | B2 * | 3/2005 | Frenken | B21D 39/031 29/525.06 |
| 10,589,341 | B2 * | 3/2020 | Draht | F15B 11/022 |
| 2017/0259326 | A1 * | 9/2017 | Skolaude | B21J 15/26 |
| 2019/0001392 | A1 * | 1/2019 | Draht | B21J 15/285 |

FOREIGN PATENT DOCUMENTS

| | | |
|---|---|---|
| CN | 204093916 | 4/2015 |
| CN | 208195379 | 12/2018 |
| DE | 10021781 | 11/2001 |
| DE | 102006028568 | 11/2007 |
| DE | 102014016130 | 4/2015 |
| DE | 102014016131 | 4/2015 |
| DE | 102014113438 | 5/2015 |
| DE | 102016111616 | 12/2017 |
| GB | 330704 | 6/1930 |

OTHER PUBLICATIONS

European Search Report in related EP application No. 19152134 dated Jul. 4, 2019, 4 pages.

* cited by examiner

*Primary Examiner* — Matthew Katcoff

(74) *Attorney, Agent, or Firm* — Andrew M. Calderon; Roberts Calderon Safran & Cole, P.C.

(57) ABSTRACT

A tool carrier for a clinching installation, having a housing having a longitudinal axis (L), in which housing a down-holder which is impinged by a first compression spring, an outer die which is impinged by a second compression spring, and an inner die which is rigidly connected to the housing are disposed coaxially within one another so as to be routed out of the housing) by way of the free ends of said down-holder and dies, is distinguished in that the first compression spring is disposed so as to be coaxial within the second compression spring.

18 Claims, 6 Drawing Sheets

TOOL CARRIER FOR A CLINCHING DEVICE

FIELD OF THE INVENTION

The invention relates to a tool carrier for a clinching installation, having a housing having a longitudinal axis, in which housing a downholder which is impinged by a first compression spring, an outer die which is impinged by a second compression spring, and an inner die which is rigidly connected to the housing are disposed coaxially within one another so as to be routed out of the housing by way of the free ends of said downholder and dies.

DISCUSSION OF BACKGROUND INFORMATION

A clinching device having such a tool carrier is known, for example, from DE 10 2006 028 568 A1. This tool carrier has a die unit having two dies which are disposed to as to be mutually concentric, wherein the outer die is connected to a first force transmission system for transmitting a first forming force up to a first maximum force in the region of the female die, and the inner die is connected to a second force transmission system for transmitting a second forming force up to a second maximum force in the region of the anvil. The respective forming force herein acts on the associated regions of the joining parts that are disposed in an overlapping manner, so as to produce a clinch connection (or a cut-clinch connection, respectively).

The subdivision of the die unit into an inner die and an outer die having a respective maximum forming force facilitates a forming of the material of the joining parts that is differentiated and correct in dissimilar forming regions and thus facilitates the production of a flawless joint between said joining parts. A suitable respective forming force is introduced into the corresponding region of the joining parts at a desired point in time and for a preferred duration by means of the associated force transmission systems. In order to protect or prevent, respectively, a plastic deformation of the joining part on the side of the die, the outer die is surrounded by the downholder which when the tool carrier moves toward the joining parts is pushed into the housing in the opposite direction.

The first force transmission system for transmitting the first forming force is composed of the joining force applied by the drive unit and of a restoring force applied by a rubber spring. The second force transmission system is formed by the drive force of the tool carrier that acts directly on the inner die. The tool carrier is of considerable size on account of the spring assembly chosen.

A device for placing an adjoining element on a workpiece, or for clinching the workpiece is known from DE 10 2016 111 616 A1, said device besides a die unit and an opposite female die unit having a die that is movable in the joining direction and a downholder that is compressible on the workpiece. The female die unit is provided with bearing means for bearing on the workpiece. In a disengaged position of the female die unit, the bearing means project beyond the female die portion in the direction toward the die unit, and in a lowered position of the female die unit a work piece side facing the female die is capable of being supported on the bearing means and on the female die portion.

DE 10 2014 016 131 A1 discloses a joining device for joining at least two components that are disposed in an overlapping manner by way of a cutting die for punching a first of the components while forming a punching slug, having an anvil that is disposed so as to be concentric with the cutting die and so as to be movable in a translatory manner relative to said cutting die, and having a punch element that for applying a punching force is movable in a translatory manner relative to the cutting die and for subsequently clinching the second component to the first component. A magnet is provided for holding the punching slug.

DE 100 21 781 A1 describes a joining tool for joining at least two workpieces from a ductile material. The tool is composed of a frame, a female die, a joining die, a downholder, and a drive for the joining die and the downholder. The frame is composed of an upper frame part and a lower frame part. The upper frame part is configured as a housing that is open toward one side and is otherwise closed, and the lower frame part is configured so as to be C-shaped. The drive is composed of a pneumatically activated actuator cylinder which is disposed in the interior of the upper frame part, and of a force transmission mechanism that connects the actuating cylinder to the joining die and the downholder.

A method for connecting an upper sheet-metal part and a lower sheet-metal part, of which at least one is embodied as an organic panel, with the aid of an auxiliary joining part and a perforated metal disk is known from DE 10 2014 113 438 A1.

SUMMARY OF THE INVENTION

Proceeding therefrom, the invention is based on the object of reducing the installation space required for the tool carrier.

In order for said object to be achieved, a generic tool carrier is distinguished in that the first compression spring is disposed so as to be coaxial within the second compression spring.

On account of this design embodiment, the installation space required in the axial direction is first reduced. Moreover, the compression spring provided for the outer die can be configured as a helical spring which in relation to a rubber spring can absorb significantly higher forces at a smaller volume.

The second compression spring is preferably supported on a hollow-cylindrical sleeve which is operatively connected to the outer die, a first ring which is operatively connected to the downholder being received in a sliding manner in the internal bore of said hollow-cylindrical sleeve, the first compression spring being supported on said first ring, wherein the first ring has a central bore through which the inner die is routed.

On account of this design embodiment, the force of the second compression spring can be directed by way of the hollow-cylindrical sleeve to the outer die, and the force of the first compression spring can be directed by way of the ring to the downholder.

The force transmission from the first compression spring to the downholder is simplified when the sleeve in the internal bore thereof has an encircling shoulder which is provided with a plurality of bores through which in each case one pin is routed, said pin by way of one end thereof bearing axially on the first ring and by way of the other end thereof bearing on the downholder.

A second ring can be disposed between the encircling shoulder of the sleeve and the first ring. The external diameter of the second ring is preferably smaller than the inner circle configured by the plurality of pins, and the second ring can be supported on the first ring and the encircling shoulder such that said second ring can serve as a spacer and for guiding the pins.

The housing is preferably configured in at least two parts, and a lower part provided with a central bore is capable of being screw-fitted onto an upper part that is connectable to a machine tool.

The assembly of the housing is simplified when said housing is configured in three parts, and an inner internal part that comprises the inner die is capable of being screw-fitted into or onto the upper part.

BRIEF DESCRIPTION OF THE DRAWINGS

An exemplary embodiment of the invention is to be described in more detail hereunder with the aid of a drawing in which.

DETAILED DESCRIPTION

Figure 1:
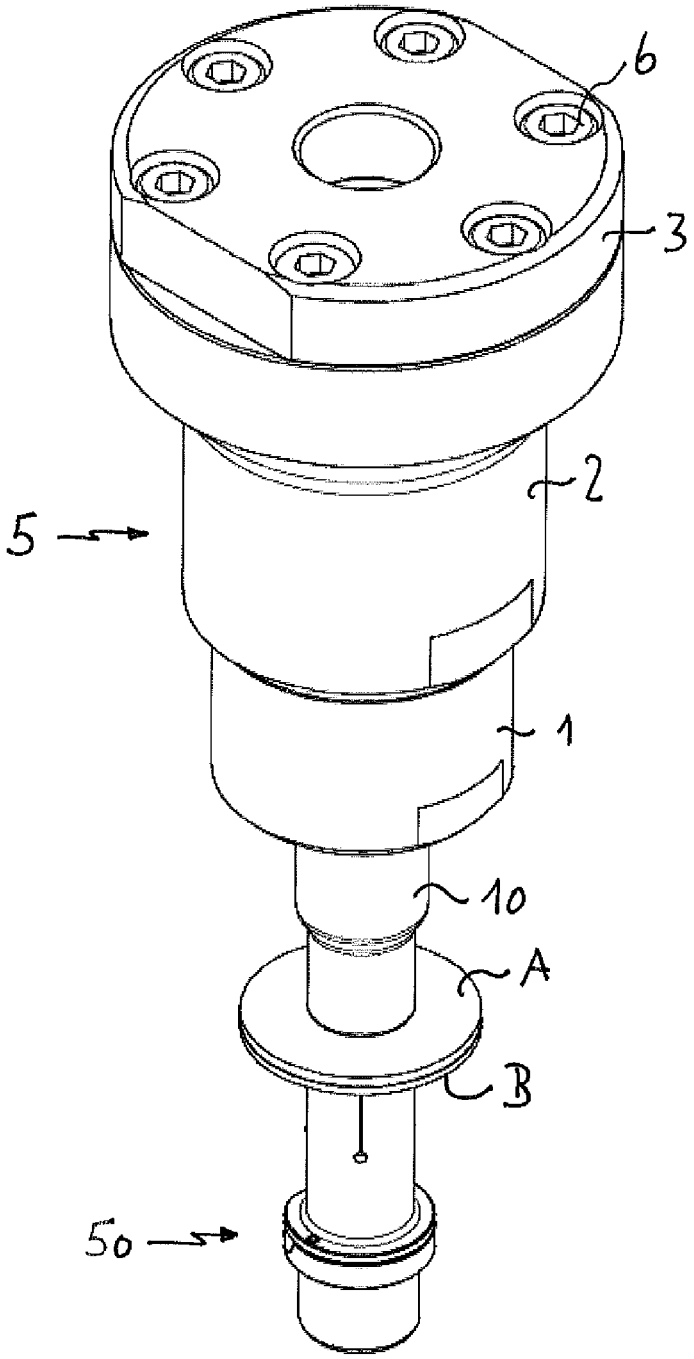
FIG. 1—shows the perspective illustration of a clinching installation composed of a tool carrier and a female die.
Figure 2:
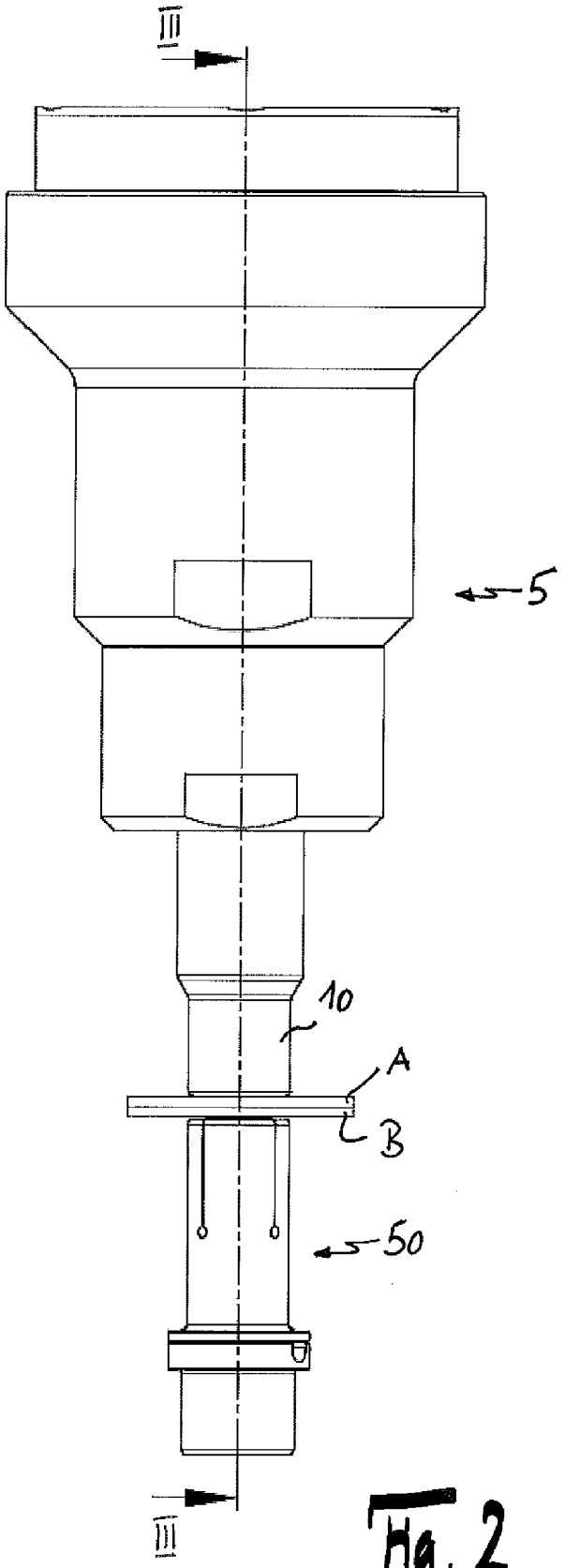
FIG. 2—shows a view of the clinching installation according to FIG. 1.
Figure 3:
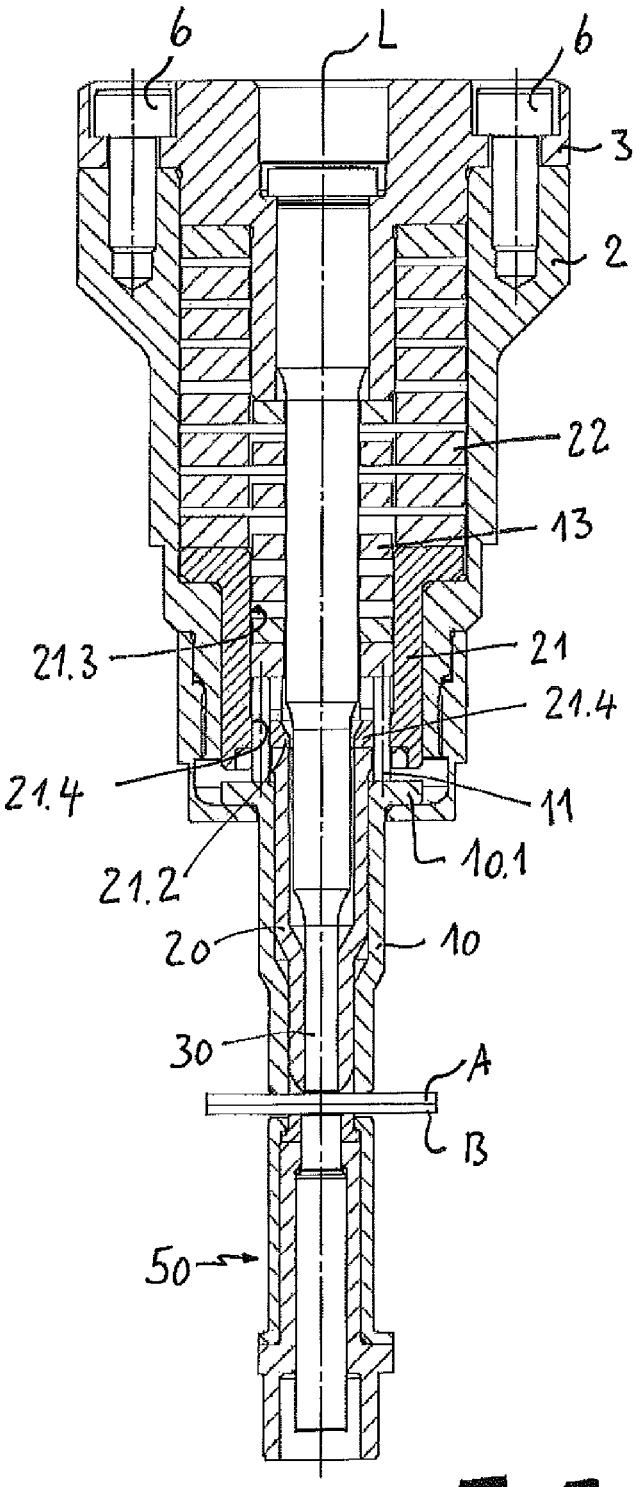
FIG. 3—shows the section along the line III-Ill according to FIG. 2.
Figure 4:
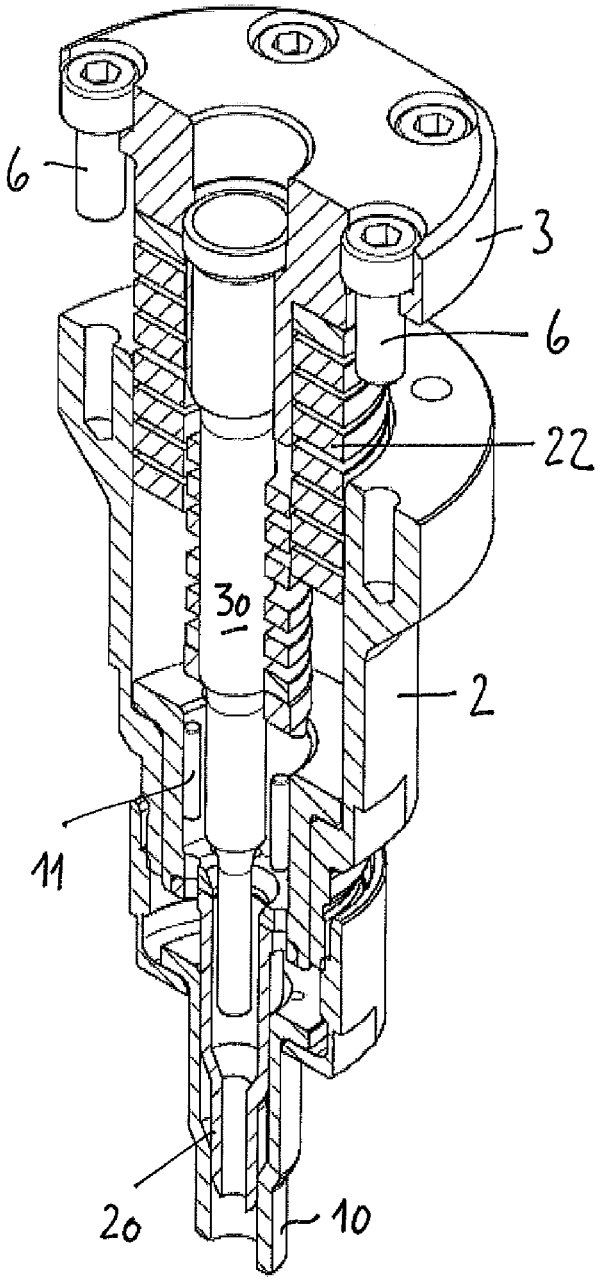
FIG. 4—shows a perspective longitudinal section through the tool carrier according to FIG. 1.
Figure 5:
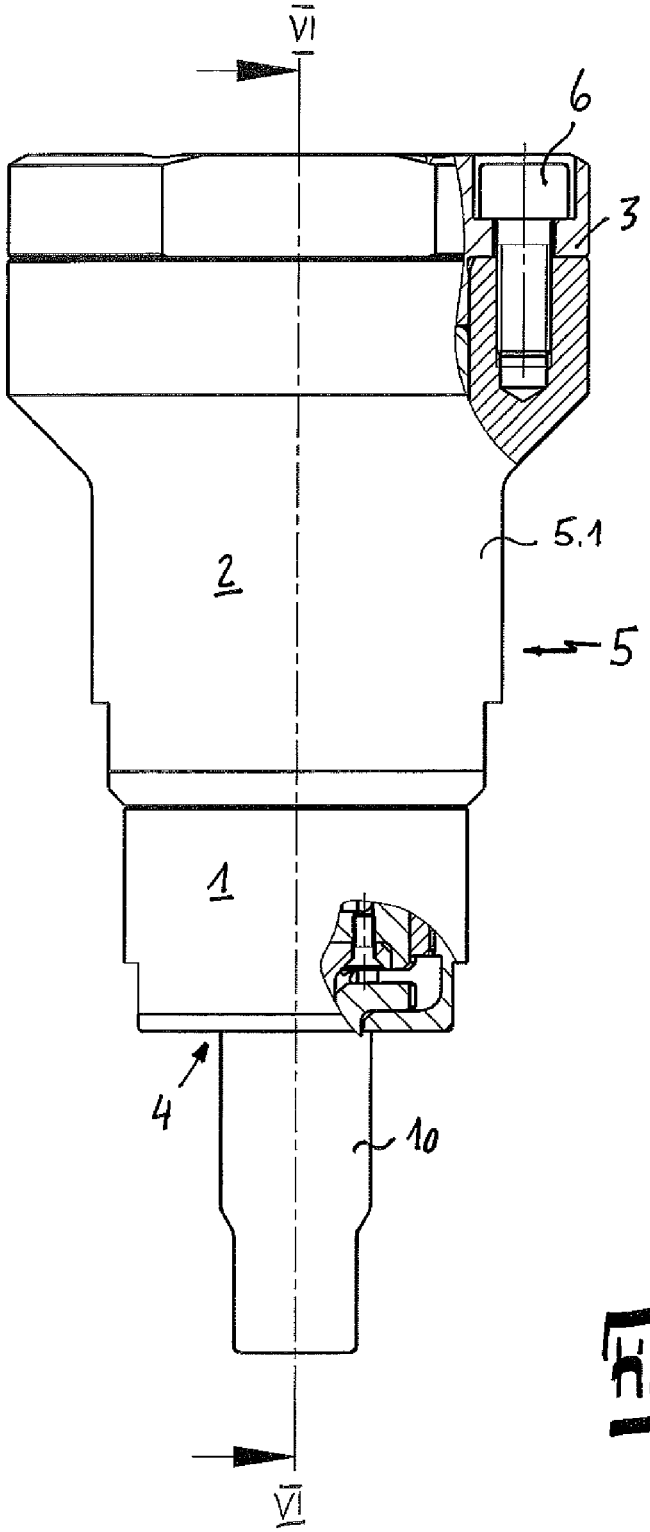
FIG. 5—shows the view of a tool carrier.
Figure 6:
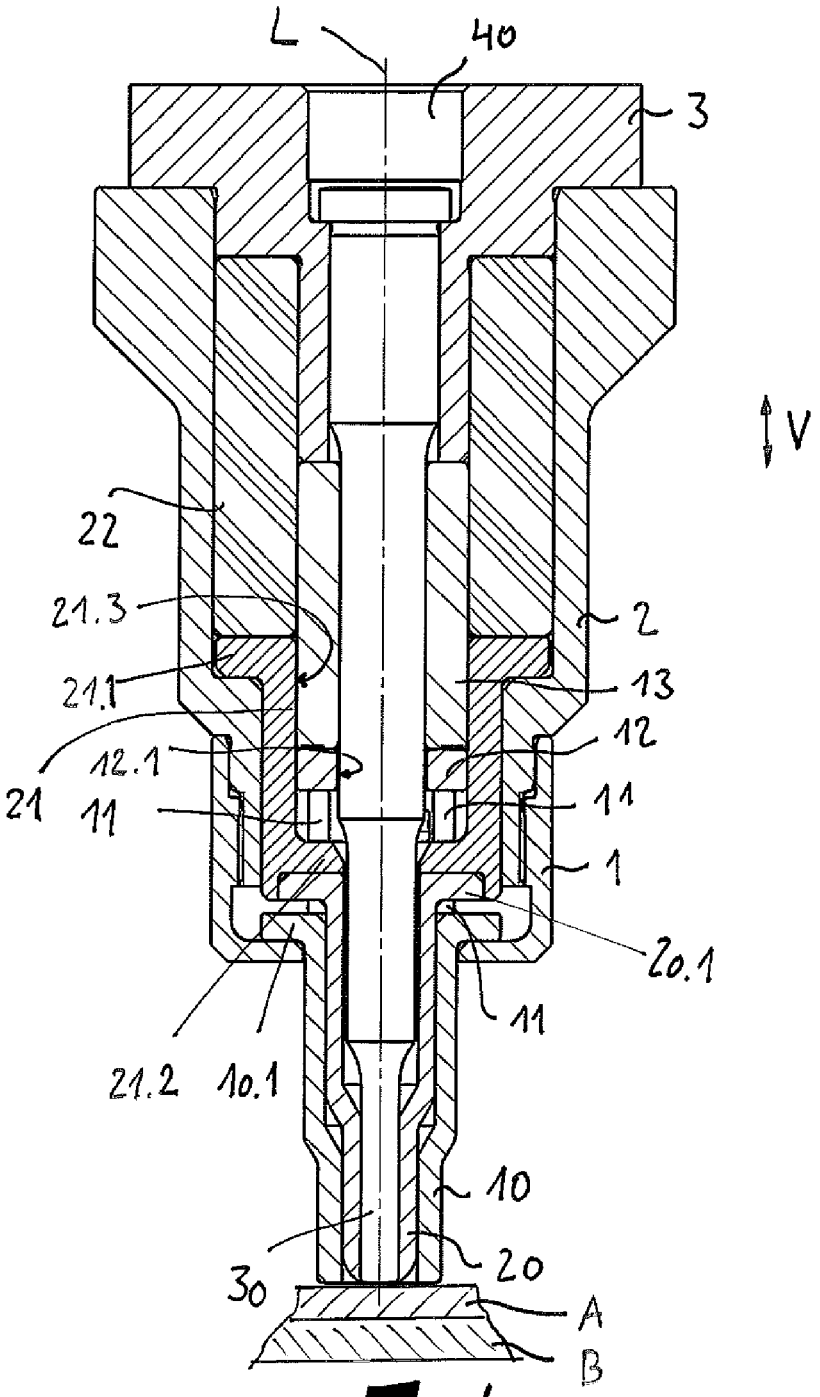
FIG. 6—shows the section along the line VI-VI of the tool carrier according to FIG. 5.

The clinching installation is composed of the tool carrier 5 and the female die 50. The components A, B to be joined are placed between the tool carrier 5 and the female die 50 and are then connected to one another by forming by way of the tools 20, 30 that are received in the tool carrier 5.

The tool carrier 5 is composed of a three-part housing 5.1, the lower part 1 thereof, provided with a central bore 4, being capable of being screw fitted onto the upper part 2, and the internal part 3 thereof by means of a plurality of screws 6 being screwed to the upper part 2 or being inserted into the latter.

A downholder 10, an outer die 20 and an inner die 30 are provided so as to be nested in one another and so as to be disposed so as to be mutually coaxial in the housing 5.1. The inner die 30 is inserted in the internal part of the housing part 3 and by way of said internal part of the housing part 3 is connected directly to the ram 40 of the machine tool (not illustrated in more detail here) which drives the tool carrier 5 in the axial direction V. The outer die 20 can move in the vertical direction V in relation to the inner die 30. The outer die 20 is surrounded by the downholder 10 which can move in the vertical direction V in relation to the outer die 20. The outer die 20 by way of the sleeve 21 is connected to a compression spring 22; the downholder 10 is connected to the compression spring 13 by way of pins 11 that are disposed on a circle and by way of a ring 12.

The sleeve 21 is configured so as to be hollow-cylindrical, having an upper flange 21.1 and a lower encircling shoulder 21.2 which protrudes into the internal bore 21.3 and configures an inwardly directed flange. A plurality of bores 21.4 are provided in the lower shoulder 21.2, pins 11 that are supported on the flange 10.1 of the downholder 10 running through said bores 21.4. The pins 10 by way of the other end thereof bear on a ring 12 which has an internal bore 12.1 and which is supported on the compression spring 13.

The outer die 20 at that end thereof that is located in the housing 5.1 is widened so as to form a flange 20.1. In order for the two joining parts A, B to be connected to one another, the tool carrier 5 is moved toward the joining part A that faces said tool carrier 5.

When the tool carrier 5 lands on the upper joining part A and is further moved thereonto, the joining force applied by the ram 40 acts on the joining parts A, B. The downholder 10, by way of the pins 11 and the ring 12, is pushed counter to the force of the compression spring 13 in the opposite vertical direction V (upward in the drawing) into the housing 5.1, while the outer die 20 and the inner die 30 are moved further in the direction toward the joining parts A, B. Upon achieving a specific force, the outer die 20 which by way of the flange 20.1 thereof bears on the sleeve 21, conjointly with the sleeve 21, slides counter to the force of the compression spring 22 into the interior of the housing 5.1, while the inner die 30 continues to move toward the joining parts A, B and produces the clinch connection in that said inner die 30 moves into the female die 50.

The invention claimed is:

1. A tool carrier for a clinching installation, comprising:

a housing having a longitudinal axis (L), in which the housing comprises:

a downholder which is impinged by a first compression spring, an outer die which is impinged by a second compression spring, and an inner die which is rigidly connected to the housing are disposed coaxially within one another so as to be routed out of the housing by way of the free ends of said downholder and dies, wherein the first compression spring is disposed so as to be coaxial within the second compression spring, the second compression spring is supported on a hollow-cylindrical sleeve which is operatively connected to the outer die, a first ring which is operatively connected to the downholder being received in a sliding manner in an internal bore of said hollow-cylindrical sleeve, the first compression spring being supported on said first ring, and in that the first ring has a central bore through which the inner die is routed, and the cylindrical sleeve in an internal bore thereof has an encircling shoulder which is provided with a plurality of axial bores through which in each case one pin is routed, said pin by way of one end thereof bearing on the first ring and by way of the other end thereof bearing on the downholder.

2. The tool carrier according to claim 1, further comprising-a second ring disposed between the encircling shoulder of the sleeve and the first ring.

3. The tool carrier according to claim 2, wherein the external diameter of the second ring is smaller than a circle configured by the plurality of pins, and the second ring is supported on the first ring and the encircling shoulder.

4. The tool carrier according to claim 1, wherein the housing is configured in two parts, wherein a lower part provided with a central bore is capable of being screw-fitted onto an upper part that is connectable to a machine tool.

5. The tool carrier according to claim 4, wherein the housing is configured in three parts, wherein an inner internal part that comprises the inner die is capable of being screw-fitted into or onto the upper part.

6. A tool carrier for a clinching installation, comprising:

a housing having a longitudinal axis (L), in which the housing comprises:

a downholder impinged by a first compression spring, an outer die impinged by a second compression spring, wherein the first compression spring is disposed so as to be coaxial within the second compression spring, an inner die rigidly connected to the housing;

a first ring operatively connected to the downholder; and a cylindrical sleeve comprising an encircling shoulder which is provided with a plurality of axial bores through which pins are routed, the pins bearing on a first ring operatively connected to the downholder.

7. The tool carrier according to claim 6, wherein the inner die and outer die are disposed coaxially within one another so as to be routed out of the housing.

8. The tool carrier according to claim 6, wherein the first compression spring is a helical spring.

9. The tool carrier according to claim 6, wherein the second compression spring is supported on the cylindrical sleeve which is operatively connected to the outer die and the first ring is received in a sliding manner in an internal bore of the cylindrical sleeve.

10. The tool carrier according to claim 9, wherein a force of the second compression spring is directed by the cylindrical sleeve to the outer die, and a force of the first compression spring is directed by the first ring to the downholder.

11. The tool carrier according to claim 6, wherein the second compression spring is disposed between the encircling shoulder of the cylindrical sleeve and the first ring.

12. The tool carrier according to claim 6, further comprising a second ring disposed between the encircling shoulder of the cylindrical sleeve and the first ring, wherein an external diameter of the second ring is smaller than an inner circle configured by the pins in the plurality of axial bores.

13. The tool carrier according to claim 12, wherein the second ring is supported on the first ring and the encircling shoulder such that the second ring serves as a spacer and for guiding the pins.

14. A tool carrier for a clinching installation, comprising:

a housing;

an outer die disposed to be co-axial in the housing;

an inner die nested within the outer die and disposed so as to be co-axial in the housing such that the outer die moves in a vertical direction in relation to the inner die;

a sleeve;

an outer compression spring connecting to the outer die by the sleeve;

an inner compression spring connecting to the housing;

pins; and a downholder, by way of the pins, being pushed counter to a force of the inner compression spring in an opposite vertical direction into the housing, while the outer die and the inner die are moved in a second direction, wherein, upon achieving a predetermined force, the outer die bears on the sleeve conjointly with the sleeve sliding counter to the force of the compression spring into an interior of the housing, while the inner die continues to move toward the second direction and produces a clinch connection.

15. The tool carrier according to claim 14, wherein the outer die moves in a vertical direction in relation to the inner die, and the outer die is surrounded by the downholder which moves in the vertical direction V in relation to the outer die.

16. The tool carrier according to claim 14, wherein the downholder is connected to the inner compression spring by way of the pins which are disposed in a circle and by way of a ring.

17. The tool carrier according to claim 16, wherein the ring has an internal bore and which is supported on the compression spring.

18. The tool carrier according to claim 14, wherein the sleeve is a hollow-cylindrical shape comprising an upper flange and a lower encircling shoulder which protrudes into an internal bore and configures an inwardly directed flange, a plurality of bores are provided in the lower encircling shoulder, and the pins are supported on the flange of the downholder running through the bores.

* * * * *